US010804668B2

(12) United States Patent
Bussmann et al.

(10) Patent No.: US 10,804,668 B2
(45) Date of Patent: Oct. 13, 2020

(54) DEVICE FOR ASSEMBLING A PLUG HOUSING

(71) Applicant: komax Holding AG, Dierikon (CH)

(72) Inventors: Thomas Bussmann, Lauerz (CH); Beat Estermann, Dierikon (CH)

(73) Assignee: Komax Holding AG, Dierikon (CH)

( * ) Notice: Subject to any disclaimer, the term of this patent is extended or adjusted under 35 U.S.C. 154(b) by 260 days.

(21) Appl. No.: 15/722,245

(22) Filed: Oct. 2, 2017

(65) Prior Publication Data

US 2018/0097328 A1 Apr. 5, 2018

(30) Foreign Application Priority Data

Oct. 3, 2016 (EP) ..... 16192019

(51) Int. Cl.
*H01R 43/20* (2006.01)
*H01R 13/432* (2006.01)

(52) U.S. Cl.
CPC ..... *H01R 43/20* (2013.01); *H01R 13/432* (2013.01)

(58) Field of Classification Search
CPC .. H01R 43/048; H01R 43/052; H01R 13/432; H01R 43/20; H01R 43/29; H01R 43/432; H02G 1/14; H05K 13/06
See application file for complete search history.

(56) References Cited

U.S. PATENT DOCUMENTS 3,504,488 A 4/1970 Illman
4,341,065 A 7/1982 Baumgartner et al.
4,835,844 A 6/1989 Gerst et al.
5,083,370 A 1/1992 Koch et al.
5,157,830 A 10/1992 Koch
5,237,809 A 8/1993 Oestreich et al.
6,842,975 B2 1/2005 Revel et al.
8,161,721 B2 4/2012 Chiasson et al.
(Continued)

FOREIGN PATENT DOCUMENTS

DE 38 22 166 C2 * 7/1989
DE 10 2014 005242 B3 7/2015
(Continued)

OTHER PUBLICATIONS

European Office Action in EP 16192019.4-1801, dated Mar. 16, 2017, with English translation of relevant parts.
(Continued)

*Primary Examiner* — Carl J Arbes
(74) *Attorney, Agent, or Firm* — Collard & Roe, P.C.

(57) ABSTRACT

The present invention relates to a device (1) for assembling at least one plug housing (200) with prepared cable ends (111, 121) of a cable harness (100), in particular a twisted harness comprised of at least two cables (110, 120), wherein the device (1) has at least two cable grips (10, 20) each for gripping one of the at least two cables (110, 120) on a segment (112, 122) of a free cable end (111, 121), in particular untwisted. For selective assembly, in particular for insertion of the cable ends (111, 121) with a longitudinal offset into the plug housing (200) through a segment along the path of travel, which is potentially critical for a successful assembly process, the at least two cable grips (10, 20) are displaceable independently of one another in the longitudinal direction (L) of the cable ends (111, 121) to be gripped.

12 Claims, 5 Drawing Sheets

(56) References Cited

U.S. PATENT DOCUMENTS

| | | | |
|---|---|---|---|
| 8,646,822 | B2 | 2/2014 | Braun et al. |
| 9,194,079 | B2 | 11/2015 | Kudou et al. |
| 9,416,488 | B2 | 8/2016 | Stier et al. |
| 9,466,111 | B2 | 10/2016 | Frey |
| 9,624,607 | B2 | 4/2017 | Keil |
| 10,052,676 | B2 | 8/2018 | Keil et al. |
| 2002/0173204 | A1 | 11/2002 | Yamanashi et al. |
| 2012/0324857 | A1 | 12/2012 | Ogawa |
| 2014/0298770 | A1 | 10/2014 | Kudou et al. |
| 2015/0101700 | A1 | 4/2015 | Stier et al. |
| 2016/0114375 | A1 | 4/2016 | Keil et al. |
| 2018/0093849 | A1 | 4/2018 | Estermann et al. |

FOREIGN PATENT DOCUMENTS

| | | | |
|---|---|---|---|
| EP | 3 348 615 | A1 | 1/1990 |
| EP | 1 032 095 | A1 | 8/2000 |
| EP | 1 317 031 | A1 | 6/2003 |
| EP | 1 429 430 | A2 | 6/2004 |
| EP | 2 317 613 | A1 | 5/2011 |
| EP | 3 012 841 | A1 | 4/2016 |
| EP | 3 021 430 | A1 | 5/2016 |
| EP | 3 301 768 | A1 | 4/2018 |
| JP | H07-240267 | A | 9/1995 |
| WO | WO 1989000347 | A1 * | 1/1989 |

OTHER PUBLICATIONS

European Office Action in EP 16192006.1-1809, dated Apr. 21, 2017, with English translation of relevant parts.

* cited by examiner

DEVICE FOR ASSEMBLING A PLUG HOUSING

CROSS REFERENCE TO RELATED APPLICATIONS

Applicant claims priority under 35 U.S.C. § 119 of European Application No. 16192019.4 filed on Oct. 3, 2016, the disclosure of which is incorporated by reference.

The present invention relates to a device and a method for assembling at least one plug housing with prefabricated cable ends of a cable harness, in particular twisted, having at least two cables, wherein the device has at least two cable grips, each for gripping one of the at least two cables on one free segment, in particular untwisted, of the cable end.

Cable harnesses such as those used in automobiles or airplanes, for example, consist of a plurality of cables provided with so-called plug housings, which is usually referred to as assembly or assembling of the plug housings. To do so, cable ends that have been prepared in advance, i.e., cut to length, stripped of insulation and provided with contact parts, are inserted into the chambers, i.e., receptacles, in the plug housing.

The cables of a cable harnesses usually have individual cable ends to be assembled and to this end are also inserted individually into the chambers in the plug housings by using appropriate mechanical devices. To an increasing extent, cable harness comprised of a plurality of individual cables have recently also been used in cable harness consisting primarily of twisted cable pairs, for which there is also a need to assemble the free cable ends, in particular cable ends of the cable harness that have been untwisted and optionally stretched. In addition to twisted cable pairs and/or cable harnesses, however, it is also possible to use untwisted cable pairs and/or cable harnesses or other multi-cable cable systems in which the cables are merely disposed side by side and are optionally combined in a composite, for example, two or more individual cables surrounded by a sheathing. There is therefore a general need for being able to assemble cable harnesses from at least two cables, in particular twisted cables, using appropriate mechanical devices at the cable end.

Devices for assembling plug housings with individual cables and/or cable ends of individual cables are basically known from the prior art. Thus, for example, EP 2 317 613 A1 describes a device and a corresponding method for assembling plug housings with cable ends by means of a cable grip, which has two clamping jaws for gripping the cable end, these jaws being controllable in a coarse movement and a fine movement. EP 1 317 031 A1, also describes an assembly device for such purposes also having a force sensor suitable for monitoring the assembly process by using a force sensor. Monitoring of assembly processes by means of force sensors is necessary in particular in potentially critical segments along the path of travel of the prefabricated cable end into the plug housing(s). Such potentially critical segments along the path of travel relate in particular to the so-called insertion segment in the insertion area of the plug housing receptacle and/or plug housing chamber on which a cable end to be inserted may become stuck because of inadequate or faulty prepositioning, or which may be missed completely by the cable end to be inserted. Furthermore, plug housings may also have so-called sealing mats, which must be punctured during the assembly process by the contacts on the prefabricated cable ends. Such sealing mats may be situated either in front of the chambers and/or plug housing receptacles or as an intermediate piece in the chambers and/or plug housing receptacles of the plug housing. In particular such punctured sealing mats represent critical segments along the path of travel of the cable end during the assembly process. Restraint devices or locking devices which engage with the contacts that are inserted are present in the plug housings so that the prepared cables can no longer be pulled out of the plug housing after assembly. Conversely, the contacts on the cable ends may have such restraint or locking devices that engage in the housing in the end position. To ascertain whether the contact has been properly locked, a pull-out test is usually performed after successful assembly, in which test the cable is pulled with a reduced force, while at the same time the force acting on the cable is monitored. Therefore, the insertion into the restraint and/or locking devices also constitutes a critical segment along the path of advance.

In addition to EP 1 317 031 A1, EP 0 348 615 A1 also discloses an assembly device for individual cables in which the contact and the cable are each held by a grip, and the correct locking of the contact onto the plug housing is tested by means of a force-monitored pulling motion. If any problems occur at the potentially critical segments along the path of travel during assembly of individual cables, then with the devices known from the prior art so far, it is still possible to reprocess individual cables from the assembly process with no problem. To do so, the cable to be inserted is retracted and advanced again in the direction of the plug housing in order to repeat the insertion process and/or assembly process. Alternatively, if any problems occur, the cable grip is capable of a vibrating movement to overcome the critical situation, for example, if a contact becomes stuck on insertion into the insertion segment of the plug housing receptacle because of a slight incorrect positioning relative to the plug housing receptacle or if it is pushed.

However, such monitoring measures and correction measures are not possible with cable harnesses comprised of a plurality of cables when using the devices and methods known from the state of the art up to now because the individual cables are connected to one another within the cable harness, and the cable ends at one end of the cable harness reach and pass the respective potentially critical segments along the path of travel essentially at the same time at one end of the cable harness. For the same reason, it is also impossible to carry out monitoring of force for individual cables within the cable harness using the devices known previously from the state of the art.

The object on which the present invention is based is thus to implement a device and a method for assembly of at least one plug housing using prefabricated cable ends of a cable harness comprised of a plurality of cables, in which the assembly procedure for the prefabricated cable ends of the cable harness, in particular with regard to potential critical segments along the path of travel in or into the plug housing, each of which can take place as independently of one another as possible.

This object is achieved by a device according to the invention. Advantageous embodiments of the invention are discussed below.

To assemble the individual prefabricated cable ends at one end of a cable harness as independently of one another as possible, it is provided according to the invention that the cable ends are to be inserted and passed through segments along the path of travel that are potentially critical for a successful assembly process with a longitudinal offset one after the other. To this end, the device according to the invention has at least two cable grips for gripping one each of the at least two cables on a free segment of the respective cable end, in particular a segment that is untwisted. To produce the longitudinal offset according to the invention and to insert and pass the cable ends into and through the potentially critical segments along the path of travel with a longitudinal offset one after the other, the at least two cable grips are designed to be displaceable independently of one another in the longitudinal direction of the cable ends to be gripped.

According to an advantageous embodiment of the invention, the at least two cable grips are designed to be displaceable in the longitudinal direction of the cable ends to be gripped along the path of travel independently of one another, at least by and/or over the length of a segment, in particular the longest one of the potentially critical segments along the path of travel. This achieves the result in particular that the prefabricated cable ends, in particular the contact elements attached there are the segments and/or zones, which are potentially critical for the assembly procedure and in which the force should preferably be monitored, can be passed individually. Each cable end can thus be passed individually and/or separately through a potentially critical zone and can be monitored by means of force sensors.

In the sense of the present invention, the cable ends of the cable harness to be assembled are the cable ends situated at one end of the cable harness. Furthermore, in the sense of the present invention, the cable ends to be assembled are present freely on one end of the cable harness, i.e., the composite of the cable harness, for example, the twisting thereof is released in the area of the cable ends to be assembled, so that, in the case of an otherwise twisted cable harness, for example, the cable ends and/or the cable harness is/are untwisted in the area of the cable ends and preferably also stretched. In a sense of the present invention, however, the cable ends should be "free" in any case in the sense that they are essentially released from one another, gripped independently of one another and moved in relation to one another at least in a certain area, in particular being offset in the longitudinal direction relative to one another. If the cable ends that are to be aligned according to the invention are still not free of one another, then according to one advantageous embodiment of the invention, it is possible to provide for the cable ends to be "freed," before the alignment, for example, being untwisted, and/or to release the cable harness (i.e., the composite of the cable harness, for example, the twisting of the cable harness) in the area of the cable ends, for example, to untwist it in the area of the cable ends to be aligned.

According to another advantageous embodiment of the invention, it is also possible to provide that the at least two or more cable grips are disposed one after the other in the longitudinal direction of the cable ends to be gripped and can be offset and/or displaced in the longitudinal direction independently of one another. This yields a particularly compact design of the assembly device. However, it is also conceivable for the cable grips to be disposed in the same axial position with respect to the longitudinal direction of the cable ends to be gripped, but to grip the respective cable ends from different directions transversely, in particular at a right angle to the longitudinal direction on the respective cable ends.

In the case of cable harnesses having more than two cable ends to be processed, more than two cable grips are provided, i.e., one cable grip for each cable end which can be offset and/or displaced independently of one another in the longitudinal direction of the cable ends to be gripped and are preferably disposed one after the other in the longitudinal direction.

According to another advantageous embodiment of the invention, at least one, preferably all the cable grips have a pair of gripping jaws that are adjustable relative to one another. These can be brought into at least one closed position for clamping securely one cable end and into one open position for receiving and releasing the cable end. It may preferably also be provided that the gripping jaws can be brought into an intermediate position for at least partially enclosing the cable end radially and guiding it along its longitudinal axis. This intermediate position may be used in particular to enable a subsequent re-gripping in the sense of a stepwise displacement of the cable end in the direction of the end position in the plug housing.

According to another advantageous embodiment of the invention, the gripping jaws of the at least one cable grip may be designed so that one cable end of at least one additional cable of the cable harness can also be accommodated, and in the closed position as well as preferably also in the intermediate position, the cable end can be guided at least partially radially for closing and along the longitudinal cable axis. In this way, the cable end is additionally stabilized in an advantageous manner on insertion and/or assembly during the forward advance.

According to another advantageous embodiment of the invention, for securely holding, partial radial enclosing and/or guiding the respective cables ends, the gripping jaws of the cable grip may each have corresponding gripping troughs or receiving troughs. For example, it is conceivable for the gripping jaws to be designed like the jaws of pliers. To secure a cable end in the closed position, the gripping troughs and/or receiving troughs may have a roughened surface or a ridged surface in particular. Accordingly the troughs and/or the areas of the gripping jaws, which serve only to facilitate the radial enclosing and to guide an additional cable end, may have a smooth surface.

To implement the mutually independent displacement of the at least two cable grips in the longitudinal direction of the cable ends to be gripped, according to another advantageous embodiment of the invention, it is possible to provide that one of the at least two cable grips is displaceable in the longitudinal direction relative to the other cable grip separately, in particular by means of a grip displacement device, and the other cable grip is displaceable by displacement of the entire assembly device in the longitudinal direction, in particular by means of an overall displacement device. Alternatively, it is possible to provide that the at least two cable grips are each displaceable separately, in particular each with a separate cable grip displacement device, in the longitudinal direction for mutually independent displacement of the at least two cable grips in the longitudinal direction of the cable ends to be gripped. Actuator-operated (linear) displacement devices may be considered in particular as the cable grip displacement device and/or the overall displacement device. Actuators that may be considered include, for example, pneumatically, hydraulically or electric motor-operated actuators (linear motors or rotational motors with motion converters, in particular gears).

According to another advantageous embodiment of the invention it may be provided that at least one of the cable grips is displaceable in at least one direction transversely, in particular at a right angle to the longitudinal direction of the cable ends to be gripped. In this way, a simplified guidance of the cable grip to the cable ends to be processed can be implemented in an advantageous manner. Furthermore, it is possible in this way to process plug housings with different distances between plug housing compartments to be assembled. Preferably all the cable grips are displaceable transversely, in particular at a right angle to the longitudinal direction of the cable ends to be gripped. Alternatively or additionally, it may also be provided that at least one, preferably all the cable grips are designed for performing a vibrating movement longitudinally and/or transversely to the longitudinal direction of the cable ends to be gripped. To this end, corresponding actuators may be attached to the cable grips to create such a vibrating movement. In the case of a critical situation, for example, when the cable end becomes stuck and/or the contact attached to the cable end becomes stuck, the vibrating movement serves mainly to correct the position of the cable end and thereby overcome a critical situation in the area of a critical segment, for example, in the insertion area, in the area of the sealing mat or in the area of the locking device.

To monitor the assembly process, it may additionally be provided that the device has at least one force sensor for measuring a tensile force and/or a compressive force acting on a cable end to be gripped. Ideally, a force sensor, which can measure the forces acting on the respective cable, is provided for each cable grip. Alternatively, however, only one force sensor may be provided for the entire assembly device, which then measures the forces acting on the cable over the entire device. Because of the possibility of arranging the cable ends so that they are offset in the longitudinal direction and guiding them accordingly, one after the other, through potentially critical segments along the path of travel, it is thus possible to measure the tensile forces and/or compressive forces acting along the corresponding critical segment individually for each cable end.

The object of the present invention is also achieved by the method described below for assembling at least one plug housing with prefabricated cable ends of a cable harness, in particular twisted, using the device according to the invention described previously. In this method, the prefabricated cable ends are inserted as far as the respective end position into corresponding plug housing receptacles and/or plug housing compartments of the at least one plug housing. According to the invention, this method is characterized by the following steps:

a. separate gripping of the at least two cables on a segment of the respective free cable end, in particular untwisted;
b. advancing the gripped cable ends along their longitudinal direction in the direction of the respective end position until reaching a segment, which is potentially critical for a successful assembly process, along the path of travel in or into the plug housing, in particular until reaching an insertion segment of the respective plug housing receptacle of a sealing mat segment in or in front of the plug housing receptacle or a fixation segment of the respective plug housing receptacle;
c. longitudinally offset advance of the cable ends through the critical segment, such that the cable ends of the at least two cables pass through the critical segment one after the other;
d. repeating steps b. and c. for each additional, possibly critical segment until reaching the respective end position.

According to one advantageous embodiment of the method according to the invention, it may be provided that the cable ends of the at least two cables are disposed with a longitudinal offset relative to one another corresponding at least to the length of the critical segment before the cables pass by a critical segment along their longitudinal direction. As a result of this measure, a situation is reached in which the at least two cables can then be guided individually one after the other through the critical segment and it is ensured that the following cable end does not enter the critical segment until the leading cable end itself has already passed it. Alternatively, it may also be provided that the cable ends of the at least two cables are advanced up to a critical segment and then the one cable end is first guided through the critical segment while the other cable end waits in front of the critical segment and enters the critical segment only then and is passed through it when the leading cable end has passed through the critical segment.

In the case when the cable ends are disposed with a corresponding longitudinal offset before passing through a critical segment, it may be provided according to another advantageous embodiment of the invention that the longitudinally offset advance of the cable ends through the critical segment comprises the following:

synchronous advance of the cable ends that are disposed upstream from the passing with a longitudinal offset in the direction of the respective end position until the leading cable end has passed through the critical segment, and then a separate advance of the trailing cable end through the critical segment without any additional advance of the leading cable end;

or synchronous advance of the cable ends that are disposed with a longitudinal offset upstream from the passing in the direction of the respective end position until the leading cable end and next the trailing cable end have passed through the critical segment.

According to another advantageous embodiment of the invention, the longitudinal offset between the cable ends of the at least two cables can be compensated after the trailing cable end has passed by the critical segment. This can be implemented in particular by separate advance of the trailing cable end without additional advance of the leading cable end.

In a manner similar to that with the device according to the invention, it may also be provided with the method according to the invention that in the advance of the respective cable end into and/or through a critical segment, a tensile force and/or compressive force acting on the cable end is measured. It is conceivable that the force is monitored either for each one of the cable ends in the respective advance operation or as an alternative, it is also conceivable that the force is monitored on only one of the cable ends, in particular at least one of the cable ends.

If the measured tensile force and/or compressive force should exceed a predefined value, it may be provided according to another advantageous embodiment of the invention that the advance of the corresponding cable end is stopped. Alternatively or additionally, it is possible that the advance is repeated, in particular by retracting the corresponding cable end and then advancing it again and/or by executing a vibrating motion of the cable end longitudinally and/or transversely to the longitudinal direction of the cable end.

In particular with regard to reaching the respective end position, according to another advantageous embodiment of the invention, it may be provided that a pull-out test is performed, preferably for each one of the at least two cable ends, in particular by exerting and measuring a tensile force on the corresponding cable end in opposition to the direction of insertion.

Additional goals, advantages and possible applications of the present invention are derived from the following description of an exemplary embodiment of the invention as well as on the basis of the accompanying figures.

Figure 1:
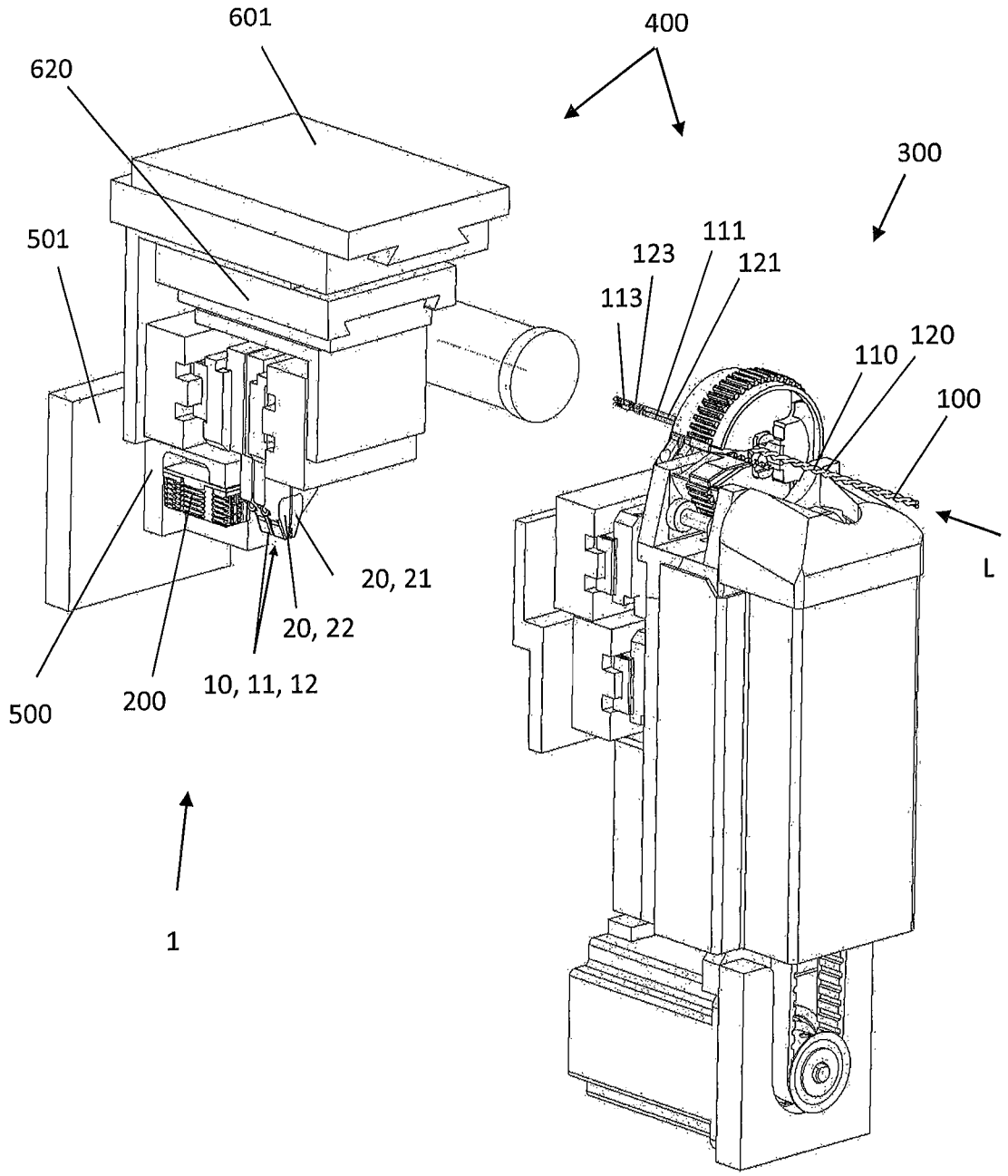
FIG. 1 shows a perspective view of an assembly unit with a possible exemplary embodiment of the assembly device according to the invention.

FIG. 1 shows an assembly unit 400 with one possible exemplary embodiment of the assembly device 1 according to the invention, which serves to assemble the plug housings 200 with the prefabricated cable ends 111, 121 of a pair of cables 100, which are twisted together in the present case, the plug housings being disposed in corresponding housing holders 500 on a so-called pallet 501. The assembly device 1 receives the cable pair 100 to be processed from a so-called alignment unit 300, such as that described in European Patent Application No. EP16192006.1, for example, by the same patent applicant, filed on the same day as the present patent application. The alignment device 300 serves to align the completely prefabricated cable ends 111, 121, which are provided in particular with contact elements 113, 123 and are untwisted and/or drawn by the otherwise twisted cable pair 100 with respect to the plug housings 200 to align them in the correct rotational position. The aligning device 300 therefore has suitable cable grips 310, 320, which can be moved horizontally together and can be lowered vertically in order to transfer the cable pair 100 to cable grips 10, 20 of the assembly device 1 having essentially the same design. As was the case with the assembly device 1, the alignment unit 300 is provided with a cable grip 10, 20; 310, 320 per cable 110, 120. The transfer takes place in such a way that the cables 110, 120 each remain clamped in at least one cable grip 10, 20; 310, 320—either on the assembly device end or on the alignment device end—so that the alignment of the contacts 113, 123 in the correction rotational position remains the same.

To insert the cable 110, 120 transferred in this way into the plug housing receptacles 210, 220 of the plug housing 200 held in the plug housing holder 500 on the pallet 501 with the help of the assembly device 1, the assembly device 1 is designed to be displaceable in the direction of the longitudinal axes L of the cable in the present example. The approach to the plug housing receptacles 210, 220 and/or plug housing chambers 210, 220 is accomplished by means of the pallet 501, which, for this purpose, can be moved horizontally and vertically, i.e., in two independent directions, i.e., transversely, in particular at a right angle to the longitudinal axis L of the cable. Other variants are of course also conceivable, in which the assembly device 1 is designed to be displaceable in several directions independently of one another, and the pallet 501 must have fewer degrees of freedom accordingly.

Figure 2:
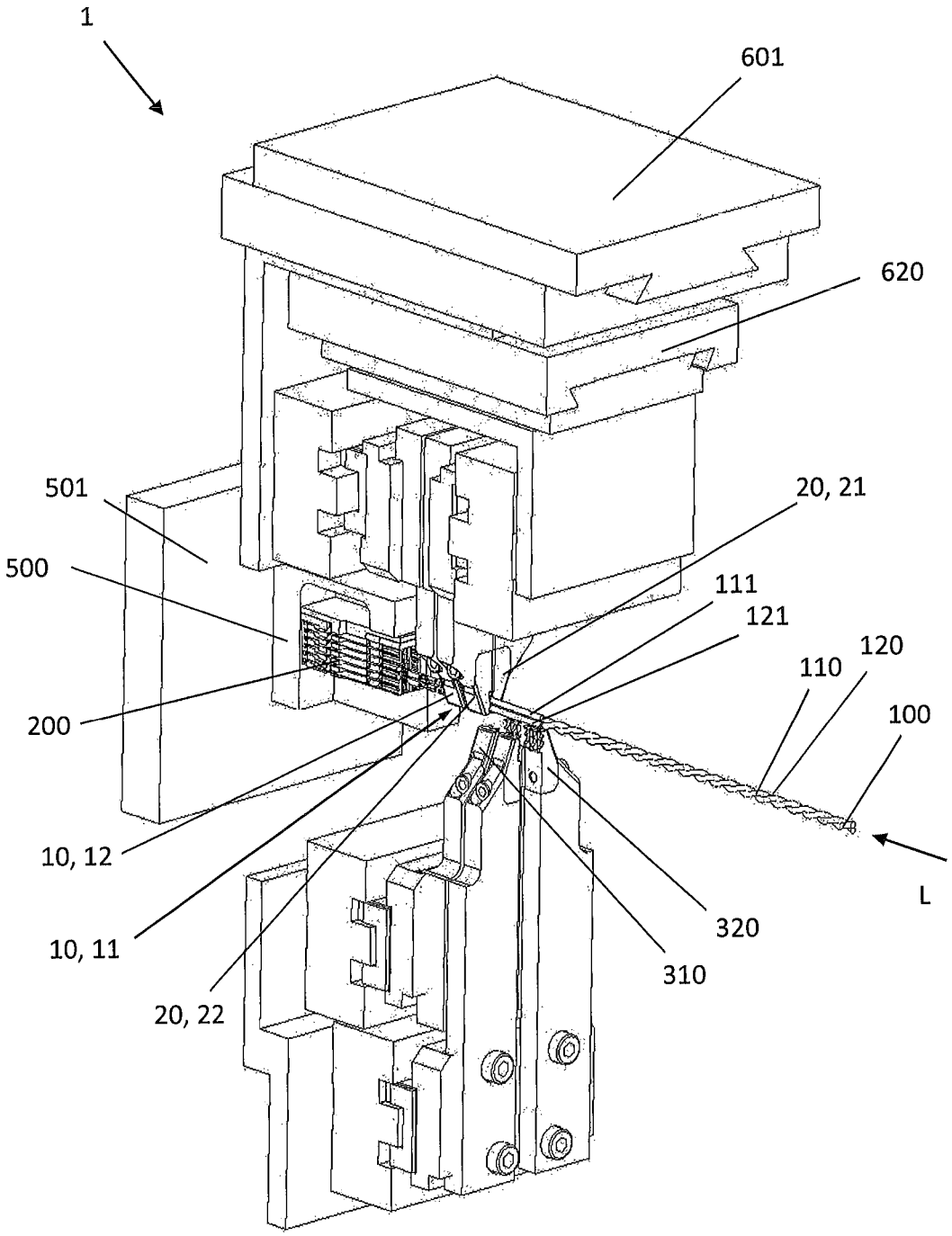
FIG. 2 shows a detailed view of the exemplary embodiment of the assembly device according to FIG. 1.

With reference to FIG. 2, the present exemplary embodiment of the assembly device 1 is described in greater detail below. The two cable grips 10, 20, each of which has a pair of gripping jaws 11, 12; 21, 22, which may be designed in particular like those of the cable grips 310, 320 of the alignment unit 300, form the heart of the assembly device 1. The gripping jaws 11, 12; 21, 22 are designed so that they each clamp a cable 110, 120 in a closed position and accordingly they surround other cables 120, 110 only radially and are guided to this extent along the longitudinal direction L thereof. The gripping jaws 11, 12; 21, 22 can be converted additionally to an open position in order to insert the two cables 110, 120 between the gripping jaws 11, 12; 21, 22 of the corresponding cable grip 10, 20 and/or to release the two cables 110, 120 again. Furthermore, in the exemplary embodiment shown here, the cable grips 10, 20 can be transferred to a so-called intermediate position in which the two cables 110, 120 are merely enclosed radially and are guided axially to this extent, so that subsequent re-gripping of the cables is made possible in particular.

The assembly device 1 may be displaced as a whole in the longitudinal direction L of the cable. For example, an actuator device 601 may be used for this purpose. In addition, one of the two cable grips 20 of the assembly device can be displaced in the longitudinal direction L of the cables 110, 120 relative to the other cable grip 10. In this regard, an actuator 620 may also be present. However, as an alternative variant, it is also possible for the two cable grips 10, 20 of the assembly device 1 to each be designed to be movable and/or displaceable individually and/or separately in the longitudinal direction L of the cable. Here again, corresponding actuators, for example, programmable servo axles (servo motors) may also be provided, although they are not shown in detail here.

For monitoring the assembly process and for carrying out a so-called pull-out test, the assembly device 1 in the present exemplary embodiment has force sensors (not shown here). The assembly device 1 preferably has one sensor, which can measure the tensile and/or compressive forces acting on the respective cable detected and/or gripped for each of the two cable grips 10, 20. Alternatively, it is conceivable that there is only one sensor which measures the forces acting on the entire assembly device 1 where these forces each act on the entire assembly device 1 in the longitudinal direction L of the cable.

In order to enable assembly of plug housings 200 with different distances between the plug housing receptacles and/or plug housing chambers 210, 220, it may also be provided that the entire assembly device 1 is designed so that at least one of the two cable grips 10, 20 is additionally designed to be displaceable in a corresponding direction transversely to the longitudinal axis L of the cable. In this case, the gripping jaws 11, 12; 21, 22 of the corresponding cable grip 10, 20 may be designed in such a way that the non-clamping internal contours of the gripping jaws 11, 12; 21, 22 are designed to be slot-shaped, for example. In this way, different cable distances can be processed using the same gripping jaws 11, 12; 21, 22.

It is provided according to the invention that the two cable grips 10, 20 of the assembly device 1 can each grip a cable 110, 120 of the cable pair 100 and are designed to be movable and/or displaceable independently of one another in the longitudinal direction L of the cables 110, 120 according to the invention. In the present exemplary embodiment, the cable grips 10, 20 of the assembly device 1 are also disposed one after the other in the longitudinal direction L of the cables 110, 120 in order to implement a particularly compact design of the assembly device 1. With regard to the method according to the invention, it is provided that the two cable ends 111, 121 which are provided with contact elements 113, 123 for the assembly process 1 can each be disposed offset from one another in the longitudinal direction L, so that the respective contacts 113, 123 on the prefabricated cable ends 111, 121 of the two cables 110, 120 can pass by potentially critical segments 211, 212, 213; 221, 222, 223, one after the other and/or individually, along the path of travel in the direction of the plug housing 200 and/or the end position of the plug housing 200, and in particular can also implement an independent force monitoring.

On the basis of FIGS. 3*a-i*, one exemplary embodiment of the assembly process with the help of the assembly device 1 shown here will be presented below as an example in order to insert the prepared stretched cable ends 111, 121 of an otherwise twisted pair of cables 100 provided with contact elements 113, 123 into the respective plug housing receptacles and/or plug housing chambers 210, 220 of a plug housing 200, in which a sealing mat device 212, 222 is additionally provided. The method shown here may also be carried out similarly with plug housings that do not have sealing mats or with plug housings that have a sealing mat, which is disposed on the outside in front of the insertion openings in the plug housing.

Figure 3A:
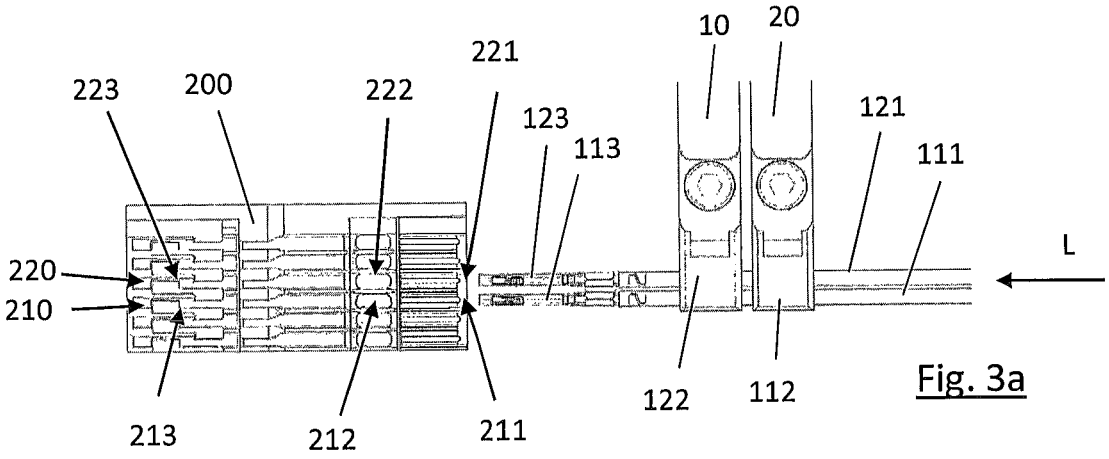
FIGS. 3*a-i* show an illustration of an exemplary embodiment of the method according to the invention using the assembly device according to FIG. 1.
Figure 3B:
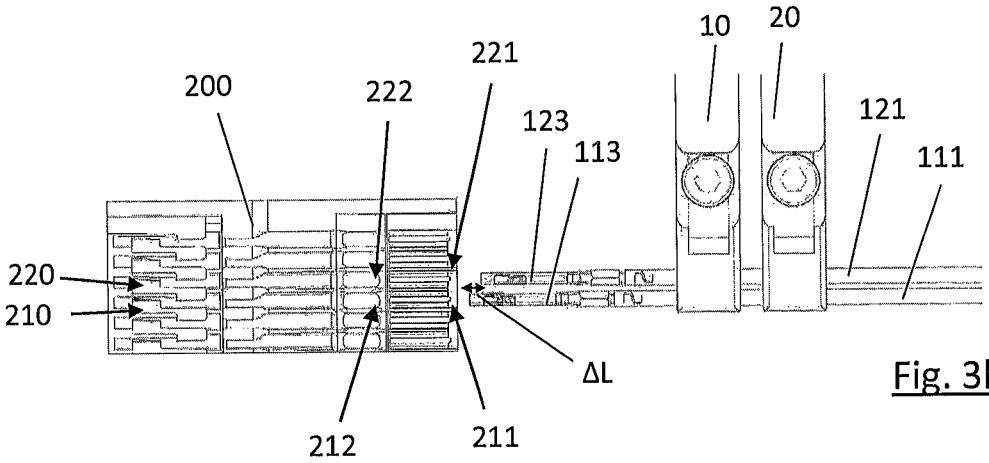
Figure 3C:
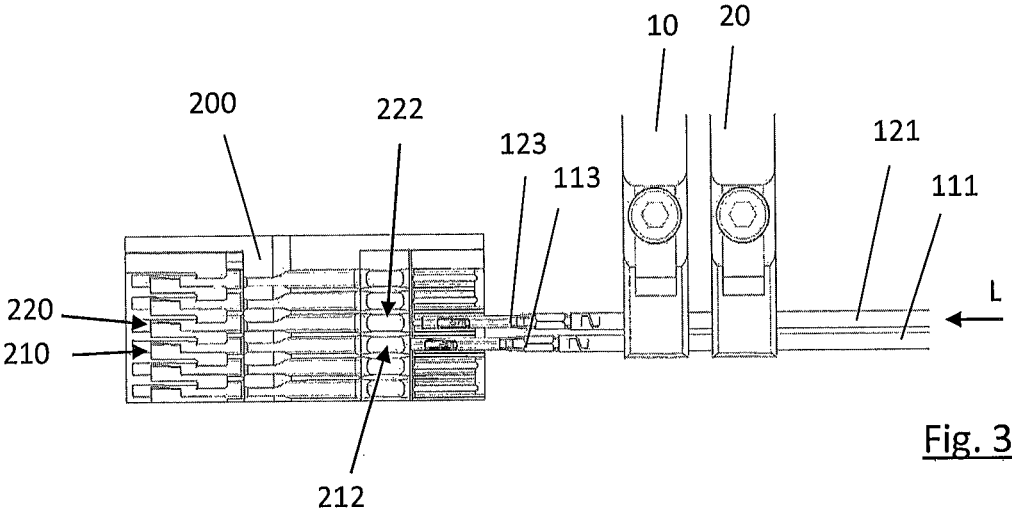
Figure 3D:
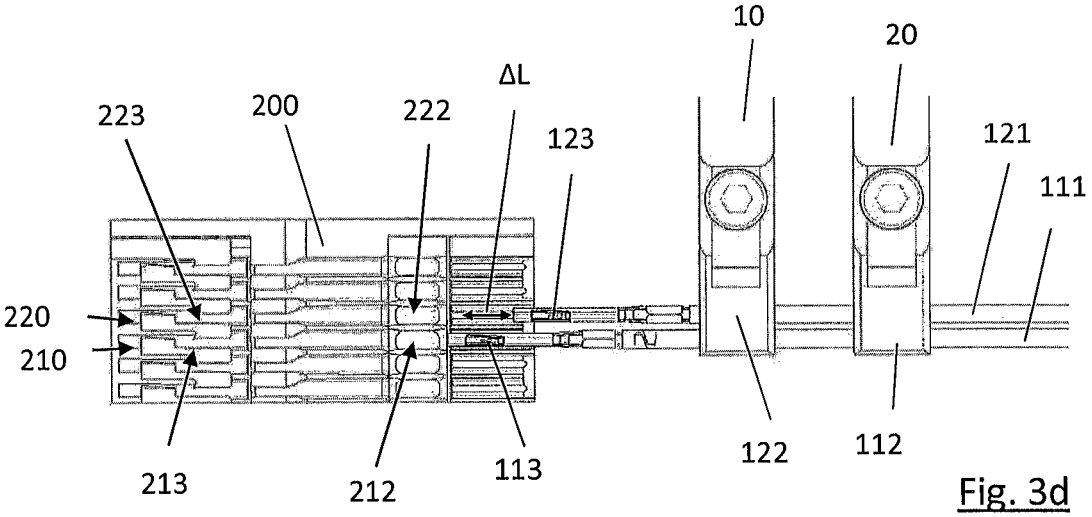
Figure 3E:
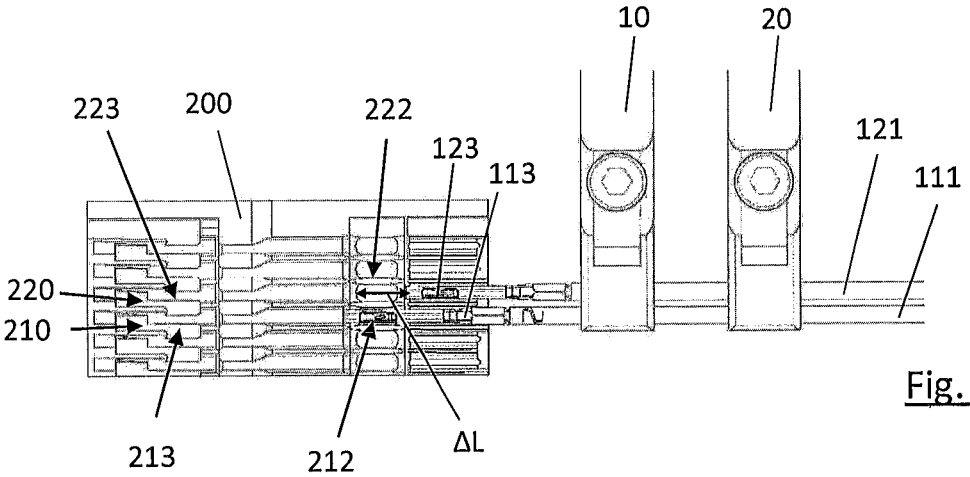
Figure 3F:
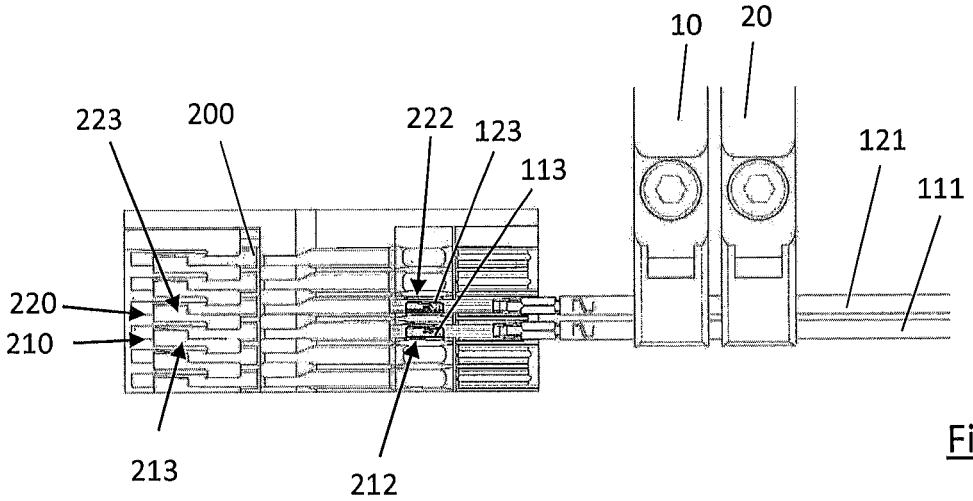

FIG. 3*a* shows the starting position of the assembly method in which the contacts 113, 123 of the cable pair 100 are positioned in the correct orientation with respect to the rotation position in front of the two plug housing chambers 210, 220. Each of the two cables 110, 120 is secured by a respective cable grip 10, 20 of the assembly device 1 on a segment of the free untwisted cable end 111, 121.

In the next step (FIG. 3*b*), one of the two cable grips 20 is pulled back to produce a longitudinal offset ΔL between the two cable ends 111, 121. The longitudinal offset ΔL corresponds at least to the length of the so-called chamber inlet 211, 221 and/or insertion segment of the corresponding plug housing chambers 210, 220, which represents a first segment along the path of travel, which is potentially critical for the assembly process.

Next the assembly device 1 is advanced in the direction of the plug housing 200 (cf. FIG. 3*c*) until the contact element 113 of the leading cable end 111 is just in front of the sealing mat device 212. During this displacement movement, the force acting on this cable end 111 is monitored. Since the two contact elements 113, 123 pass through the chamber inlet 211, 221 one after the other, the corresponding assembly force for each contact 113, 123 can be monitored individually. If a predetermined maximum force is exceeded, then it is possible to infer a collision at the chamber inlet 211, 221 and the insertion process may be repeated if necessary.

In the next step (cf. FIG. 3*d*), the rear cable grip 20 is retracted until a length offset ΔL is formed, corresponding at least to the thickness of the sealing mat device 212, 222 which represents an additional segment along the path of travel which is potentially critical for the assembly process.

Next (cf. FIG. 3*e*) the assembly device is advanced until the sealing mat 212, 222 has been punctured by the contact 113 of the leading cable end 110. Here again the assembly force can be monitored.

Following that (cf. FIG. 3*f*) the rear cable grip 20 is moved further forward in the direction of the plug housing 200 until the contact element 123 of the trailing cable end 120 has also punctured the sealing mat device 222. As an alternative variant, it is also conceivable for the assembly device 1 to be advanced with the cable grips 10, 20 disposed so that they are offset in length, and the longitudinal offset ΔL is then balanced following this step. This is advantageous in particular when the assembly force is to be monitored and there is only one force sensor for the entire assembly device 1 and there are not separate force sensors for the two cable grips 10, 20.

Figure 3G:
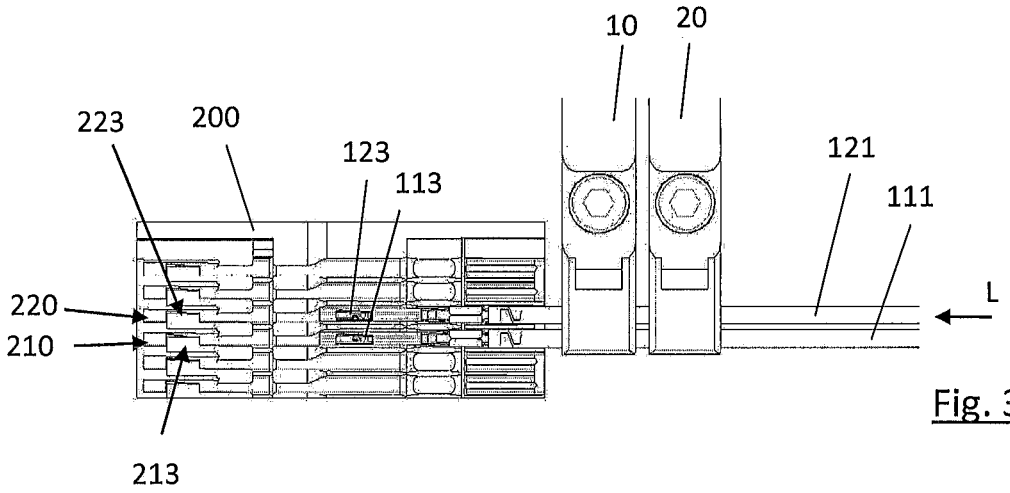
Figure 3H:
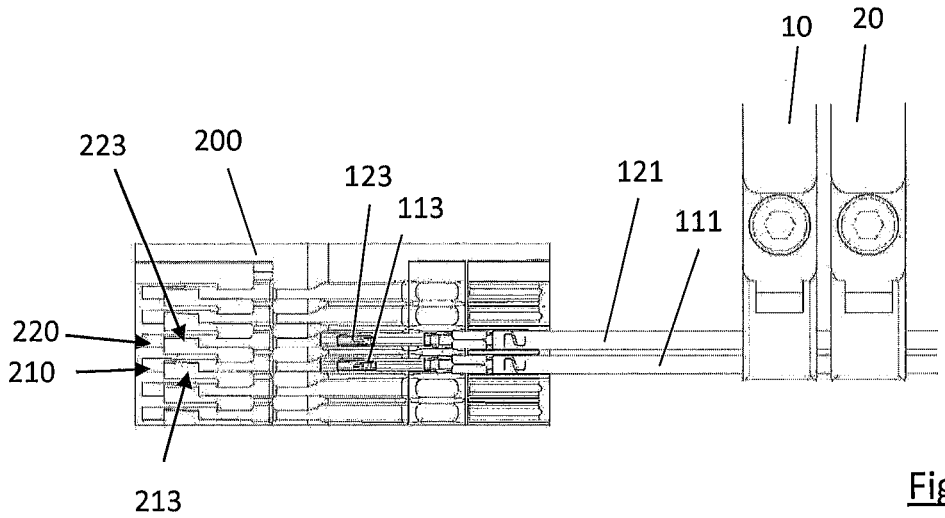
Figure 3I:
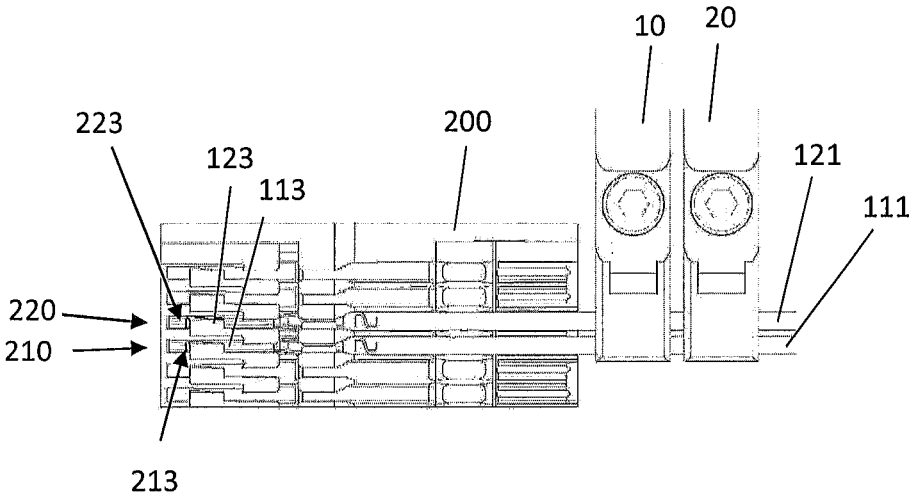

In the case when re-gripping is necessary, for example, because the path of travel inside the plug housing 200 is longer than the free displacement path of the cable grips 10, 20, the assembly device 1 can be moved forward as far as possible in the direction of the end position—as shown in FIG. 3*g*—and then the cable grips 10, 20 can be opened as far as the middle position. Next, the assembly device 1 moves back by the distance necessary for re-gripping. Then the gripping jaws 11, 12; 21, 22 of the cable grips 10, 20 are closed again to conclude the re-gripping operation (cf. FIG. 3*h*).

As the last step in the present exemplary embodiment, there is a forward movement of the entire assembly device 1 into the end position of the two contact elements 113, 123 in the plug housing 200. Reaching this end position can be detected by the force sensor and the forward movement can be stopped accordingly. For the case when the force cannot be measured for each cable 110, 120 independently, it is possible to carry out this step individually for each of the two cables 110, 120. To do so, one of the two cable grips 10, 20 can be opened as far as the middle position, so that only one cable 110 is inserted first as far as the corresponding end position (cf. FIG. 3*i*).

After conclusion of the successful assembly, a pull-out test can also be performed. To do so, the two cables 110, 120 are pulled at a reduced force by means of the assembly device 1 while at the same time the force acting on the cable ends 111, 121 is monitored to ascertain whether the two contact elements 113, 123 are properly locked in the end positions of the plug housing 200. Here again, it may be necessary to bring one of the two cable grips 10, 20 into the middle position in order to be able to carry out the pullout test for both cables 110, 120 independently of one another and/or one after the other.

After this step, the assembly process is concluded for this cable pair 100. The assembly device 1 may then receive another cable pair from the alignment unit 300, while the pallet 501 is moved to bring the plug housing chambers that are to be assembled with the next cable pair into the proper position.

What is claimed:

1. A device for assembling at least one plug housing with prefabricated cable ends of a cable harness, the cable harness being comprised of at least two cables, wherein the device comprises:

a pallet;

a housing holder connected to the pallet; and at least two cable grips connected to the housing holder, each cable grip being configured to grip a respective cable of the at least two cables on a segment of a free cable end of the respective cable, wherein for selective assembly for insertion of the cable ends-with a longitudinal offset into the plug housing through a segment of the plug housing along the path of travel, the at least two cable grips are displaceable independently of one another in a longitudinal direction of the cable ends.

2. The device according to claim 1, wherein the at least two cable grips are disposed one after the other in the longitudinal direction of the cable ends.

3. The device according to claim 1, wherein at least one of the at least two cable grips comprises at least one pair of gripping jaws that are adjustable relative to one another, that are able to be brought into a closed position for clamping securely the cable end, and are able to be brought into an open position for receiving and releasing the cable end.

4. The device according to claim 3, wherein the gripping jaws are configured to accommodate the cable end of at least one additional cable of the at least two cable grips.

5. The device according to claim 3, wherein the gripping jaws comprise corresponding gripping troughs or receiving troughs for securing, partial radial enclosing and/or guiding the respective cable ends.

6. The device according to claim 3, wherein the gripping jaws are configured to be brought into an intermediate position for at least partially enclosing radially and guiding the cable end along the longitudinal axis.

7. The device according to claim 6, wherein the gripping jaws are configured to enclose the cable end of the at least one additional cable and in the closed position and in the intermediate position to at least partially radially guide the cable end of the at least one additional cable along the longitudinal axis.

8. The device according to claim 1, further comprising an actuator connected to at least one of the pallet and the housing holder, the actuator further being connected to a first cable grip of the at least two cable grips and being configured to displace the first cable grip in the longitudinal direction.

9. The device according to claim 8, further comprising a second actuator connected to at least one of the pallet and the housing holder, the second actuator being connected to a second cable grip of the at least two cable grips and being configured to displace the second cable grip in the longitudinal direction.

10. The device according to claim 1, wherein the pallet is configured to be movable in a direction transverse to the longitudinal direction of the cable ends such that at least one of the cable grips is displaceable in the direction transverse to the longitudinal direction of the cable ends.

11. The device according to claim 1, further comprising at least one force sensor for measuring a tensile force and/or a compressive force acting on the cable end for monitoring the assembly process.

12. The device according to claim 1, further comprising an actuator attached to at least one of the at least two cable grips and attached to at least one of the pallet and the housing holder, the actuator being configured to execute a vibrating movement to the at least one cable grip longitudinally and/or transversely to the longitudinal direction of the cable ends.

* * * * *